US005885157A

United States Patent [19]

Harada et al.

[11] Patent Number: 5,885,157

[45] Date of Patent: Mar. 23, 1999

[54] DIE, DICE GAME MACHINE, AND DICE GAME SYSTEM

[75] Inventors: Mitsuhito Harada; Haruo Inoue, both of Tokyo, Japan

[73] Assignee: Eagle Co., Ltd., Tokyo, Japan

[21] Appl. No.: 688,748

[22] Filed: Jul. 31, 1996

[51] Int. Cl.[6] ..... A63F 9/04

[52] U.S. Cl. ..... 463/22; 273/145 A; 273/145 R

[58] Field of Search ..... 463/17, 22, 46, 463/47; 273/138.2, 139, 144 R, 144 B, 145 R, 145 A, 145 E

[56] References Cited

U.S. PATENT DOCUMENTS

| | | | |
|---|---|---|---|
| 518,726 | 4/1894 | Roever | 273/145 E |
| 2,302,333 | 11/1942 | Linke | 273/145 CA |
| 4,546,978 | 10/1985 | David | 273/146 |
| 4,632,397 | 12/1986 | Rivkin | 273/145 CA |

FOREIGN PATENT DOCUMENTS

| | | | |
|---|---|---|---|
| 426-301-A | 5/1991 | European Pat. Off. | 273/145 CA |
| 269284 | 4/1913 | Germany | 273/145 E |
| 405-177056 A | 7/1993 | Japan . | |
| 3016839 | 8/1995 | Japan . | |
| 1180560 | 2/1970 | United Kingdom | 273/145 C |

*Primary Examiner*—Jessica J. Harrison
*Assistant Examiner*—James Schaaf
*Attorney, Agent, or Firm*—Young & Thompson

[57] ABSTRACT

A dice game machine using a die in the shape of a regular hexahedron or dodecahedron. Each side of the die has a drawing of a symbol and is provided with a plurality of magnet pins having a pattern identifying the symbol on the opposite side. This die is accommodated in a rotatable cup having an upper portion, a lower portion, and a base opening. During the rotation of the cup, the die moves freely in the upper portion of the cup. When the rotation of the cup stops, the die falls into the lower portion of the cup in a predetermined posture. The die then has a bottom side in contact with a stage via the base opening. A plurality of Hall elements are disposed on the stage to detect corresponding magnet pins. A symbol identified by signals from the Hall elements is displayed on a display. Signals from a plurality of dice game machines are supplied to a computer which displays a combination of a plurality of symbols on the display.

27 Claims, 13 Drawing Sheets

FIG. 6

| | D1 | D2 | D3 | D4 | D5 | D6 | D7 | D8 | D9 | D10 | D11 | D12 |
|---|---|---|---|---|---|---|---|---|---|---|---|---|
| A0 | | | | | | | | | | | | |
| A1 | O | O | O | O | O | O | O | O | O | O | O | O |
| A2 | O | O | O | O | O | O | O | O | O | O | O | O |
| A3 | O | O | O | O | O | O | O | O | O | O | O | O |
| A4 | O | O | O | O | O | O | O | O | O | O | O | O |
| A5 | O | | | | | O | | | | O | | |
| A6 | | O | | | | O | O | | | O | O | |
| A7 | | | O | | | | O | O | | O | O | O |
| A8 | | | | O | | | | O | O | | O | O |
| A9 | | | | | O | | | | O | | | O |
| EFFECTIVE SYMBOL | 12 | 11 | 10 | 9 | 8 | 7 | 6 | 5 | 4 | 3 | 2 | 1 |

FIG. 10

| | D1 | D2 | D3 | D4 | D5 | D6 | D7 | D8 | D9 | D10 | D11 | D12 |
|---|---|---|---|---|---|---|---|---|---|---|---|---|
| A5 | O | | | | O | | | O | | O | O | |
| A6 | | O | | | | O | | | O | O | O | O |
| A7 | | | O | | | | O | O | O | | | O |
| A8 | | | | O | O | O | O | | | | | |
| A9 | O | O | O | O | | | | | | | O | O |

FIG. 11

| | D1 | D2 | D3 | D4 | ..... | D10 | D11 | D12 |
|---|---|---|---|---|---|---|---|---|
| GAME 1 | 1 | 2 | 3 | 4 | ..... | 10 | 11 | 12 |
| GAME 2 | 10 | 20 | 30 | 40 | ..... | 100 | 200 | 300 |
| GAME 3 | 7 7 7 | 7 | 7 | | ..... | 7 | | |
| GAME 4 | HORSE NO.1 | HORSE NO.2 | HORSE NO.3 | HORSE NO.4 | ..... | HORSE NO.10 | HORSE NO.11 | HORSE NO.12 |
| GAME 5 | SHIP NO.1 | SHIP NO.2 | SHIP NO.4 | SHIP NO.5 | ..... | SHIP NO.10 | SHIP NO.11 | SHIP NO.12 |

DIE, DICE GAME MACHINE, AND DICE GAME SYSTEM

BACKGROUND OF THE INVENTION

1. Field of the Invention

The present invention relates to a die, a dice game machine using such a die, and a dice game system using a plurality of dice game machines.

2. Description of the Related Art

A conventional die is a cube or regular hexahedron having six square sides, each side having a different symbol. Generally, these symbols are a number or a circular mark. In the case of a circular mark, one circular mark represents the number "1", and six circular marks represent the number "6".

A game using a die is known in which one die is cast on a playing board, and a win or loss is determined according to whether the number on the upper side (hereinafter called an effective side) of the die stopped on the playing board is larger or smaller. Another game is also known in which a die is cast a predetermined number of times and a win or loss is determined according to whether the multiplied sum of numbers is larger or smaller.

Still another game is known in which two dice are used and a win or loss is determined from a combination of two numbers on the effective sides. For example, if two players play the game, each player throws two dice at the same time until the two same numbers of the effective sides of the two dice are obtained. A win or loss is determined according to whether the coincident number is larger or smaller. In another game, a plurality of dice are used and a win or loss is determined according to whether the sum total of the numbers on the effective sides of the dice is larger or smaller.

With the conventional dice games, a player casts a die by hand and the number on the effective side is read by the player. A dice game machine has been long desired by which a die is automatically rolled, the number on the effective side is automatically read, and a win or loss and a calculation of scores are automatically executed. A dice game system has been also desired which has a plurality of dice machines and a prize is determined from a symbol combination of a plurality of dice.

A conventional die is a regular hexahedron and has a maximum number of "6", posing a problem of a narrow range of numbers usable by a dice game. For example, if five dice are used, the total of combinations of five numbers is only 7776 ($=6^5$).

SUMMARY OF THE INVENTION

It is a principal object of the present invention to provide a dice game machine and a dice game system, capable of automatically playing dice games.

It is another object of the invention to provide a dice game machine capable of automatically rolling a die and automatically reading a symbol on an effective side of the die, and to provide a die suitable for such a dice game machine.

It is a further object of the present invention to provide a die having a large number of sides capable of playing a variety of games.

In order to achieve the above and other objects, a die of this invention is a polyhedron having M sides, each side having the same shape and size. Each side of the die has a symbol suitable for the contents of a game. This die is made of non-magnetic material, and a plurality of symbol identifier magnets are disposed on those sides. These symbol identifier magnets have a specific layout pattern for directly or indirectly identifying the symbol on the opposite side.

The dice game machine of this invention includes a rotatable cup for movably housing the die. The cup includes an upper portion, a lower portion, and a base opening. The upper portion has a space in which the die can freely move during the rotation of the cup. The lower portion of the cup has a configuration in which the die is fitted in a predetermined posture when the cup stops. The base opening is formed at the bottom of the cup and has the same shape as each side of the die. A stage is mounted covering the base opening. A signal detector such as a Hall element is disposed on this stage.

Each side of the die is provided with a symbol identifier signal generator for generating a symbol identifier signal for directly or indirectly identifying the symbol on the opposite side. The symbol identifier signal generator is constituted by a plurality of symbol identifier magnets disposed in a specific layout pattern.

When the rotation of the cup stops, the signal detector reads the symbol identifier signal from the side in contact with the stage. A computer identifies the symbol on the effective side by using this symbol identifier signal. The symbol on the effective side and a prize according to the symbol are displayed on a display.

A dice game system of this invention has a plurality of dice game machines, a computer, and a display. The computer judges, from symbol identifier signals received from the die game machines, a combination of a plurality of symbols. In accordance with this symbol combination, a prize is determined and displayed on the display together with the symbol combination. The kinds of prizes include a score, a coin (medal), a gift, and the like which are selected in accordance with the contents of a game.

BRIEF DESCRIPTION OF THE DRAWINGS

The above objects and advantages of the present invention will become apparent from the following detailed description of the preferred embodiments of the invention when read in conjunction with the accompanying drawings, in which:

FIG. 6 is a table showing the layout of magnet pins on each side;

FIG. 10 is a table showing another example of a layout of symbol identifier magnet pins;

FIG. 11 is a table showing symbols used for a variety of games;

DETAILED DESCRIPTION OF THE PREFERRED EMBODIMENTS

Figure 1:
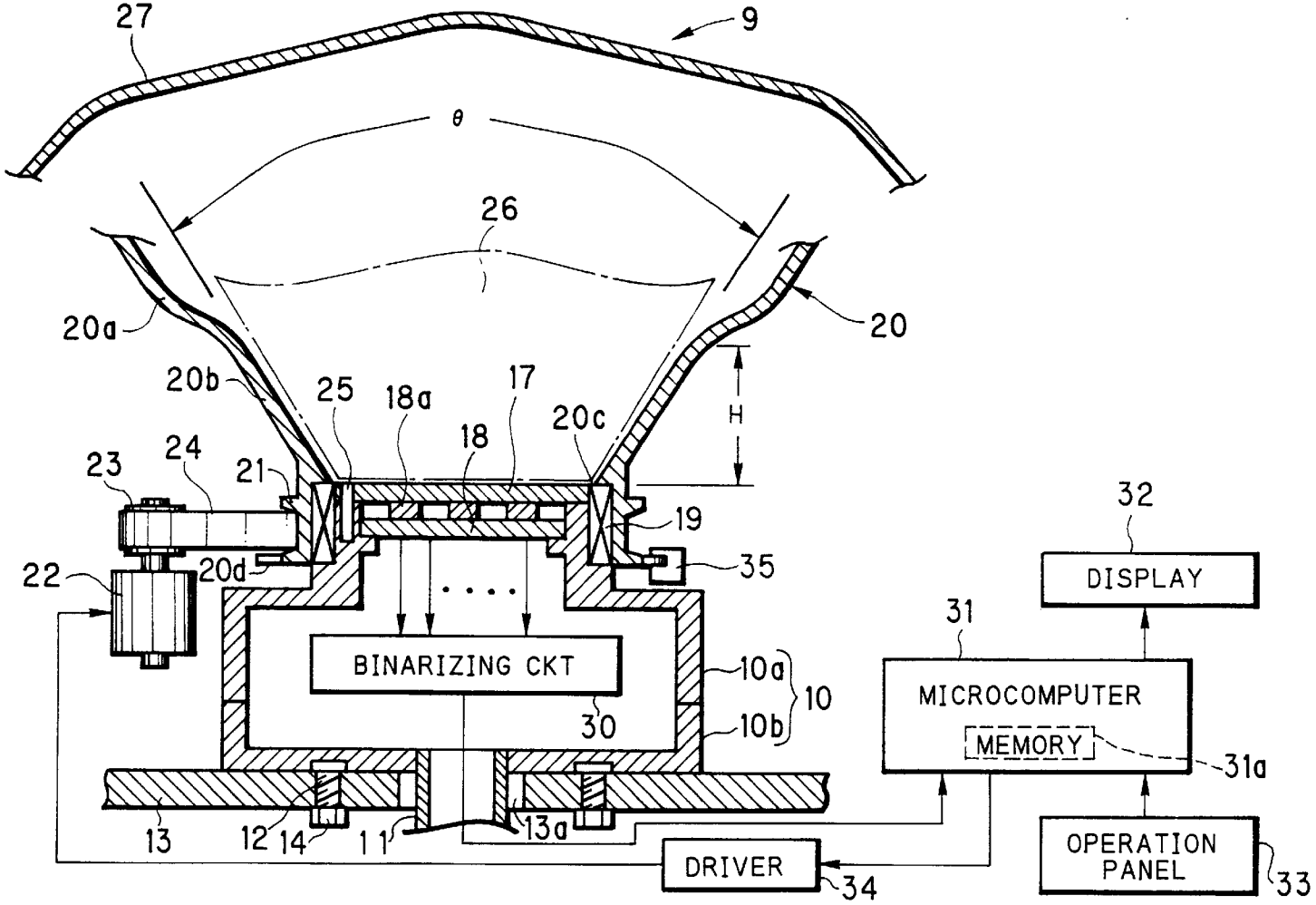
FIG. 1 is a cross-sectional view of a dice game machine according to an embodiment of the present invention.

Referring to FIG. 1 showing a dice game machine 9 according to an embodiment of the invention, a housing 10 has an upper housing 10*a* and a lower housing 10*b* which are joined together. A pipe 11 is fixedly mounted in the lower housing 10*b* and signal wires (not shown) are inserted into this pipe 11. The housing 10 is placed on a base plate 13 and fixedly mounted thereon by threading a nut 14 on a bolt 12. The pipe 11 is inserted into a hole 13*a* of the base plate 13.

The upper portion of the upper housing 10*a* is open and a circular stage 17 covers it. A sensor board 18 having a plurality of Hall elements 18*a* is fixedly mounted on the upper housing 10*a* under the stage 17. Reference numeral 18*a* is used in common for all Hall elements because there is no need of discriminating each Hall element in FIG. 1.

A bearing 19 is fixed to the outer upper circumference of the upper housing 10*a*. A pulley portion 21 of a cup 20 is fitted to the outer circumference of the bearing 19. A belt 24 extends between this pulley portion 21 and a pulley 23 of a motor 22. Rotation of the motor 22 is transmitted via the belt 24 to the pulley portion 21*a* so that the cup 20 is rotated around the upper housing 10*a* with the help of the bearing 19. The motor 22 has a brake so that the rotor thereof stops in an instant when a power supply to the motor 22 is intercepted.

The cup 20 has an upward broadening cone portion 20*a* and a pentagonal pyramid portion 20*b*. The base of the pyramid portion 20*b* is formed with a pentagonal base opening 20*c* which faces the stage 17.

A die 26 of regular dodecahedron shape is housed in this cup 20. Each side of the die 26 is a regular pentagon shape, and a seal (not shown) drawn with a symbol is attached to each side. In this embodiment, numerals "1" to "12" are used as symbols. Each side of the die is provided with a symbol identifier signal generator for generating a signal which identifies the symbol on the opposite side. Each side of the die 26 and the base opening 20*c* are pentagonal and the size of the pentagon of the base opening 20*c* is larger than that of each side. The cup 20 may be made of transparent material so as to allow a player to read the symbols on the sides other than the bottom side of the die 26 when stopped.

As the cup 20 rotates, the die 26 autorotates and revolves in the cone portion 20*a*. When the cup 20 stops, the die 26 drops down from the cone portion 20*a* into the pyramid portion 20*b*, and comes to rest in the pyramid portion 20*b*. If the posture of the die 26 is correct, the whole surface of one side comes into contact with the stage 17 in the base opening 20*c*. The top side of the die 26 is the effective side and the symbol on this effective side is an effective symbol which determines a win or loss of the game.

A positioning pin 25 is inserted in a hole formed in the stage 17 and a hole formed in the upper housing 10*a*. This positioning pin 25 is used for position alignment of the sensor board 18 and cup 20. A transparent cover 27 is mounted on the cup 20, and a player can observe the die 26 through this cover 27. The cover 27 prevents a player from touching the die 26, the die 26 from moving out of the cup 20, and dust from being introduced into the cup 20.

After the cup 20 stops its rotation, one side of the die 26 comes into contact with the stage 17. The symbol identifier signal from this side is read by each Hall element 18*a* of the sensor board 18. A signal from each Hall element 18*a* is read in a predetermined order and sent to a binarizing circuit 30. This binarizing circuit 30 converts the output signal of each Hall element 18*a* into a one-bit signal and sends it to a microcomputer 31. The symbol identifier signal read by the Hall elements 18*a* has a bit position shifted in accordance with the set position of the die 26 in the pyramid portion. Therefore, in accordance with a predetermined algorithm, the microcomputer 31 changes the order of bits and converts the signal into a normal symbol identifier signal. With this normal symbol identifier signal, a number of the effective symbol is displayed on a display 32 which may be a CRT, a liquid crystal display device, or the like.

A memory 31*a* of the microcomputer 31 stores a program for playing a game, an algorithm for changing the bit position of the symbol identifier signal. Connected to the microcomputer 31 is an operation panel 33 which has a symbol designating key, a start key, and the like. Before the cup 20 is rotated, a player selects an effective symbol, and inputs it to the microcomputer 31 through a symbol designating key of the operation panel 33. If the selected symbol coincides with the actual effective symbol, then the player is provided with a predetermined score, which is indicated on the display 32. As the start key of the operation panel 33 is activated, the microcomputer 31 causes a driver 34 to rotate the motor 22.

After a predetermined time or after a random time, the microcomputer 31 starts a motor stop operation. In this motor stop operation, the motor 22 starts being decelerated. When a photosensor 35 detects during this deceleration a light shielding piece 20*d* mounted on the cup 20, the microcomputer 31 operates to stop a power supply to the motor 22. With the built-in braking mechanism, the motor 22 is stopped in an instant to thereby stop the cup in the predetermined position. The operation panel 33 may be provided with a stop key for a player to start the motor stop operation.

In order to avoid erroneous detection by each Hall element, the housing 10, stage 17, cup 20 and die 26 are made of non-magnetic material. In this embodiment, the housing 10 and cup 20 are made of plastic. The stage 17 is made of stainless steel. The die 26 is made of plastic or rubber.

Figure 2:
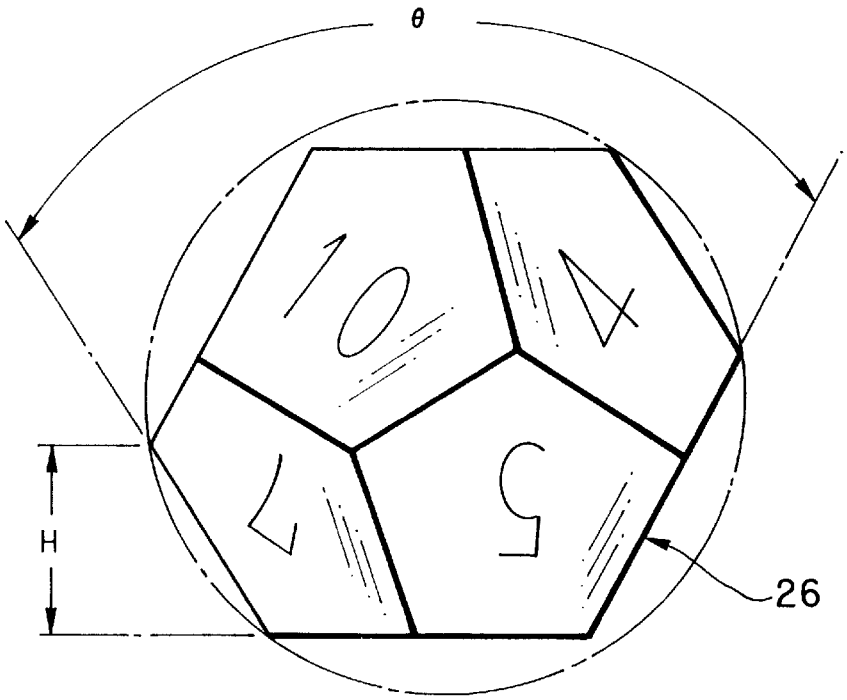
FIG. 2 is a front view of a die of regular dodecahedron shape.

Referring to FIG. 2, the die 26 is a regular dodecahedron and has twelve regular pentagonal sides. The side in contact with the stage 17 is the bottom side. The angle between two summit lines extending obliquely upward from the base side is represented by $\theta$, and the height of the summit line is represented by H. The pyramidal portion 20*b* of the cup 20 has an apex angle of $\theta$ and a height H, matching the die 26. With these dimensions, the portion of the die 26 from the base side to the height H can be stably housed in the pyramidal portion 20*b*.

Figure 3:
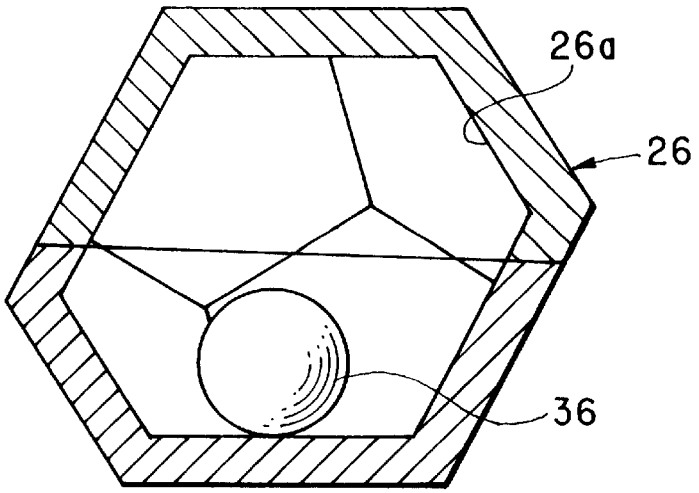
FIG. 3 is a cross-sectional view of the die.

As shown in FIG. 3, the inside of the die 26 is hollow as indicated at 26*a* and has a weight 36. The weight 36 enhances the rotation of the die 26, facilitates the die to slide into the pyramidal portion 20*b* when the cup 20 stops, and ensures a good contact between the base side and stage 17. As the weight 36 strikes the inner wall of the die 26 during rotation, sounds like a bell are generated. In this embodiment, a lead ball is used as the weight 36. The shape of the weight 37 may be pentahedral, ellipsoidal, or the like, and the material thereof may be iron, aluminum, brass, glass, or the like.

Figure 4:
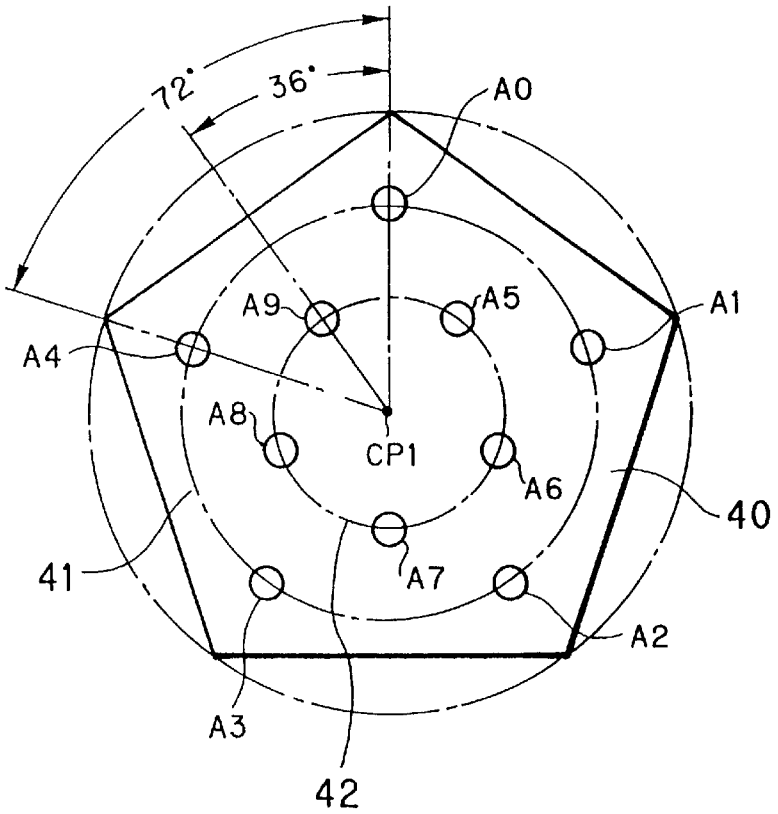
FIG. 4 is a plan view of one side of the die.

FIG. 4 shows one side of the twelve sides of the die. Five holes A0 to A4 are formed in this side 40. These five holes A0 to A4 are disposed at a pitch of 72 degrees on a virtual circle 41. Along another virtual circle 42 having a smaller radius than the virtual circle 41, five holes A5 to A9 are formed at a pitch of 72 degrees.

Posture identifier magnet pins are embedded in these holes A0 to A4, and symbol identifier magnet pins are embedded in the holes A5 to A9. The posture identifier magnet pins are used for detecting a state of the whole surface of the base side of the die 26 in contact with the stage 17, i.e., a state of the die 26 correctly fitted in the pyramidal portion 20*b*. The symbol identifier magnet pins generate magnetic symbol identifier signals representative of the code of the symbol on the opposite side. The contents of the symbol identifier signal are determined by a layout pattern of the symbol identifier magnetic pins. The shape of the cross section of these magnets may be circular, triangular, rectangular, or the like.

In this embodiment, the outer holes A0 TO A4 are formed along straight lines between the center CP1 and each corner of the regular pentagon. The inner holes A5 to A9 are displaced by 36 degrees relative to the outer holes A0 to A4. With this layout, the distance between respective holes A0 to A9 can be as great as possible so that erroneous detection by each Hall element can be prevented.

Figure 5:
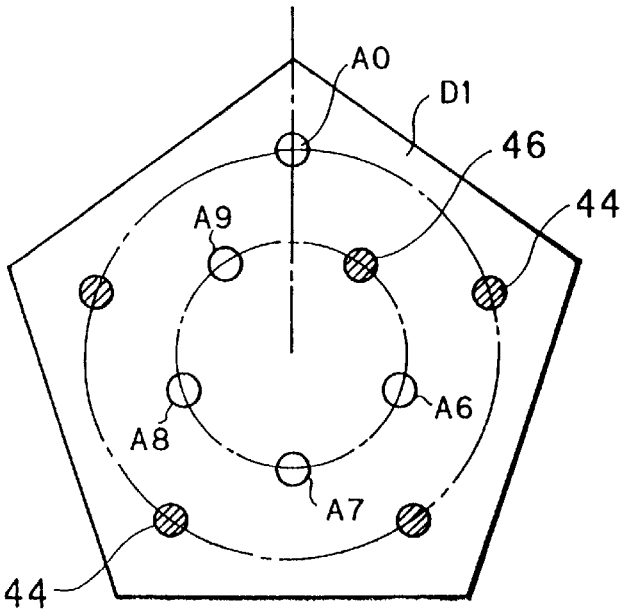
FIG. 5 is a diagram showing an example of a layout of magnet pins.

In order to discriminate between the sides of the die 26, the first side is represented by a symbol D1, and the second side is represented by a symbol D2. Similarly, the twelfth side is represented by a symbol D12. In FIG. 5, the first side D1 is shown illustratively. The posture identifier magnet pins 44 are embedded in the holes A1 to A4. However, since the hole A0 is used as a reference hole, a posture identifier magnet pin 44 is not present. The symbol identifier magnet pin 46 is embedded only in the hole A5. In order to hide these magnet pins, a seal drawn with a symbol is attached to each side after the magnet pins are inserted.

The magnet pin has a magnet property suitable for signal detection by each Hall element. In this embodiment, a ferrite magnet of paramagnetism is used. A magnetic steel such as KS steel may also be used. A ferromagnetic pin which is magnetized in a magnetic field may be used. For example, a pin of soft iron is used and a permanent magnet or an electromagnet is disposed under the sensor board 18. As the soft iron pin is magnetized by this magnet, it becomes a magnet pin and can be detected by a Hall element.

FIG. 6 shows a layout pattern of magnet pins of the first side D1 to twelfth side D12. The layout pattern of the posture identifier magnet pins is the same for all the first side D1 to the twelfth side D12. The layout pattern of the symbol identifier magnet pins is different for each of the sides D1 to D12. If a die has the same symbol on two or more sides, there are the same layout patterns of the symbol identifier magnet pins. The symbol identifier signal is decided by this layout pattern and represents the code of the symbol on the effective side.

Since the number of magnet pins is different depending upon the layout pattern of each side, the center of gravity of the die 26 shifts slightly. In order to avoid this, a non-magnetic pin having generally the same specific gravity is embedded in the empty hole in which a magnet pin is not inserted.

Figure 7:
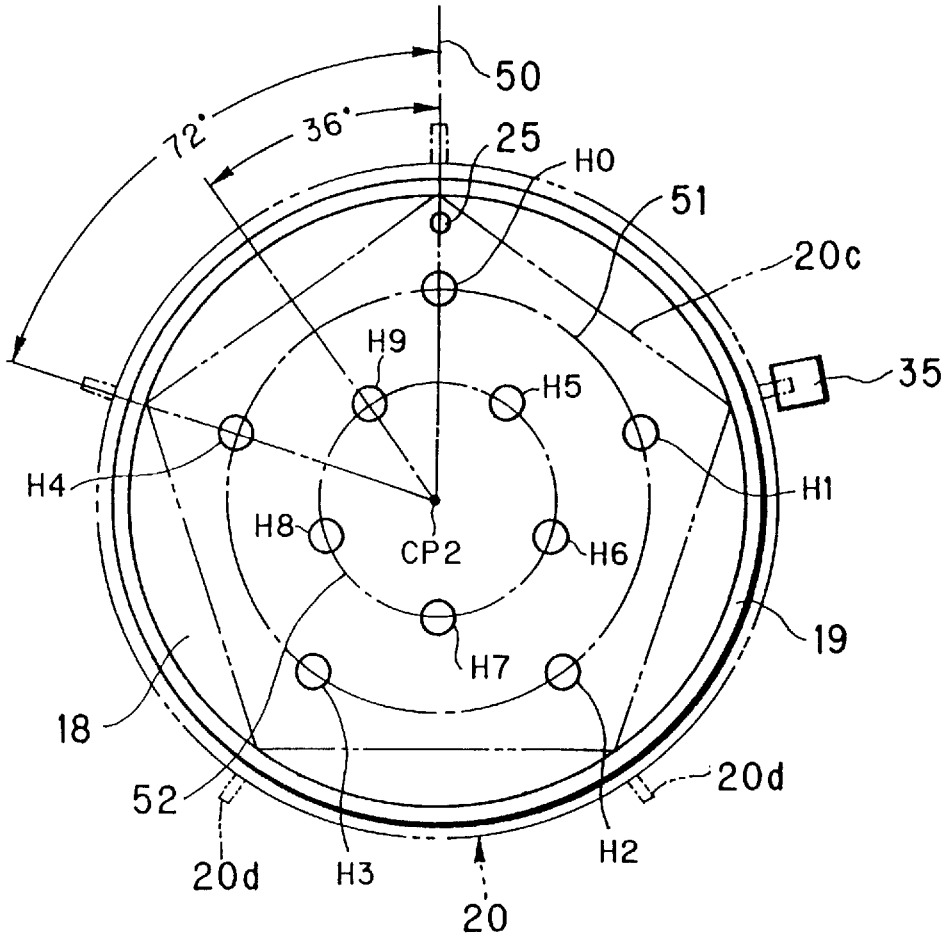
FIG. 7 is a plan view of a sensor board showing the layout of Hall elements.

FIG. 7 shows the sensor board 18 from which the stage 17 and cup 20 are dismounted. The position of the cup 20 is indicated by a two-dot-chain line. A line between the center CP2 of the sensor board 18 and the positioning pin 25 is a reference line 50. A first posture detecting Hall element H0 is disposed on the crossing of the reference line 50 and a circle 51. Second to fifth posture detecting Hall elements H1 to H4 are sequentially disposed at a pitch of 72 degrees starting from the first posture detecting Hall element H0. The circle 51 and the circle 41 shown in FIG. 4 have the same radius, and so each of the posture detecting Hall elements H0 to H4 corresponds in position to each posture identifier magnet pin at the base side of the die 26.

A first symbol detecting Hall element H5 to a fifth symbol detecting Hall element H9 are disposed on a circle 52. The first symbol detecting element H5 to fifth symbol detecting element H9 are displaced by 36 degrees relative to the first posture detecting Hall element H0 to fifth posture detecting Hall element H4. The circle 52 and the circle 42 shown in FIG. 4 have the same radius, and so each symbol detecting Hall element H5 to H9 corresponds in position to each symbol identifier magnet pin at the base side of the die 26.

When the cup 20 stops in rotation, it is necessary that each magnet pin of the die coincides in position with each Hall element. As described earlier, the pentagonal base opening 20 is formed at the bottom of the cup 20. The cup 20 is stopped so that one of the five corners of the base opening 20*c* coincide with the reference line 50. If the cup 20 is to be stopped when a particular one corner coincides with the reference line, the stopped position of the cup 20 is only one. If the cup 20 is to be stopped when one of particular two corners coincides with the reference line, the stopped positions of the cup 20 are two. In this embodiment, the cup 20 is stopped when any one of the five corners coincides with the reference line 50, and therefore the number of stopped positions of the cup 20 is five. In order to detect these stopped positions, the light shielding piece 20*d* is disposed at each of the five corners.

Figure 8:
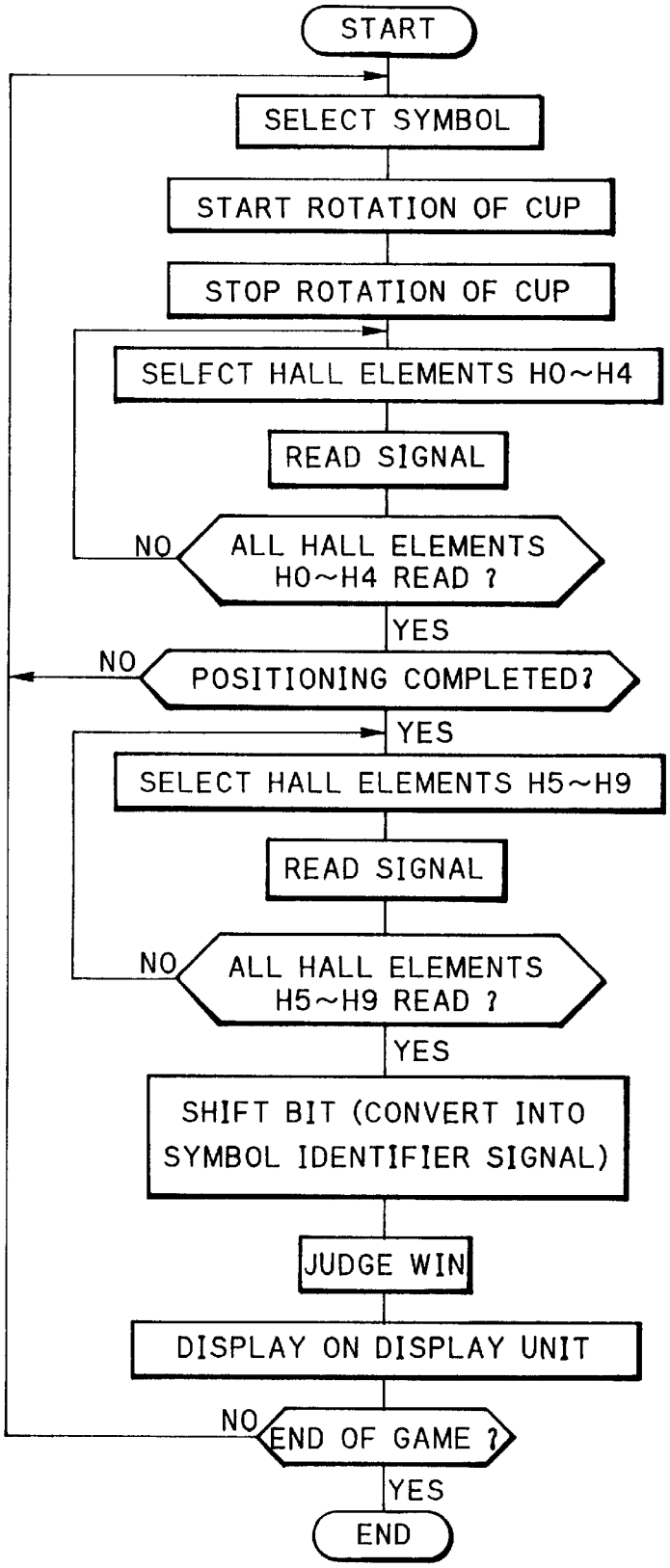
FIG. 8 is a flow chart illustrating a game sequence.

Next, with reference to FIG. 8 and 9, a number guessing game using one dice game machine 9 will be described. The effective symbol of the die 26 is predicted and this number is supplied to the microcomputer 31 by activating the symbol designating key of the operation panel 33. As the start key is activated next, the microcomputer 31 rotates the motor 22 via the driver 34. Rotation of the motor 22 is transmitted via the belt 24 to the cup 20 which in turn rotates above the housing 10. As the cup 20 rotates, the die 26 pops up from the pyramid portion 20*b* and autorotates and revolves in the cone portion 20*a*.

After a predetermined time or after a random time, the microcomputer 31 decelerates the motor 22. When the photosensor 35 detects the shielding piece 20*d* during this deceleration, the photosensor sends a detection signal to the microcomputer 31. When the photosensor detects the next light shielding piece 20*d*, the microcomputer 31 stops, via the driver 34, the power supply to the motor 22. The motor 22 is stopped in an instant by the built-in braking mechanism. As shown in FIG. 7, the cup 20 stops in a stage that one corner of the base opening 20*c* coincides with the reference line 50.

After the motor 22 is stopped, the microcomputer 31 sequentially selects and drives the posture detecting Hall elements H0 to H4. A voltage output from the selected posture detecting Hall element is binarized by the binarizing circuit 30 and converted into a signal "1" or "0". The signal "1" corresponds to a presence of the posture identifier magnet pin 44, and the signal "0" corresponds to an absence of the posture identifier magnet pin 44. This binarized signal is received by the microcomputer 31.

Each side of the die 26 has four posture identifier magnet pins 44. Therefore, if there are four "1s" in the signals of five bits fetched by the microcomputer 31, it is judged that the posture of the die 26 is correct. If there are three "1s" or less, it is judged that the base side of the die 26 is oblique. In this case, the microcomputer 31 causes the motor 22 to rotate and play the game again.

If the posture of the die 26 is correct, the microcomputer 31 sequentially selects and drives the symbol detecting Hall elements H5 to H9 and receives the signals of five bits from the binarizing circuit 30. Since each side of the die 26 is pentagonal, each symbol detecting Hall element H5 to H9 of the die 26 in the pyramid portion 20*b* takes one of five positions. Therefore, the symbol identifier signal takes one of five bit patterns and the effective symbol cannot be identified. To solve this problem, the position of the reference hole A0 is checked and the signals of five bits are shifted in a ring manner.

Figure 9:
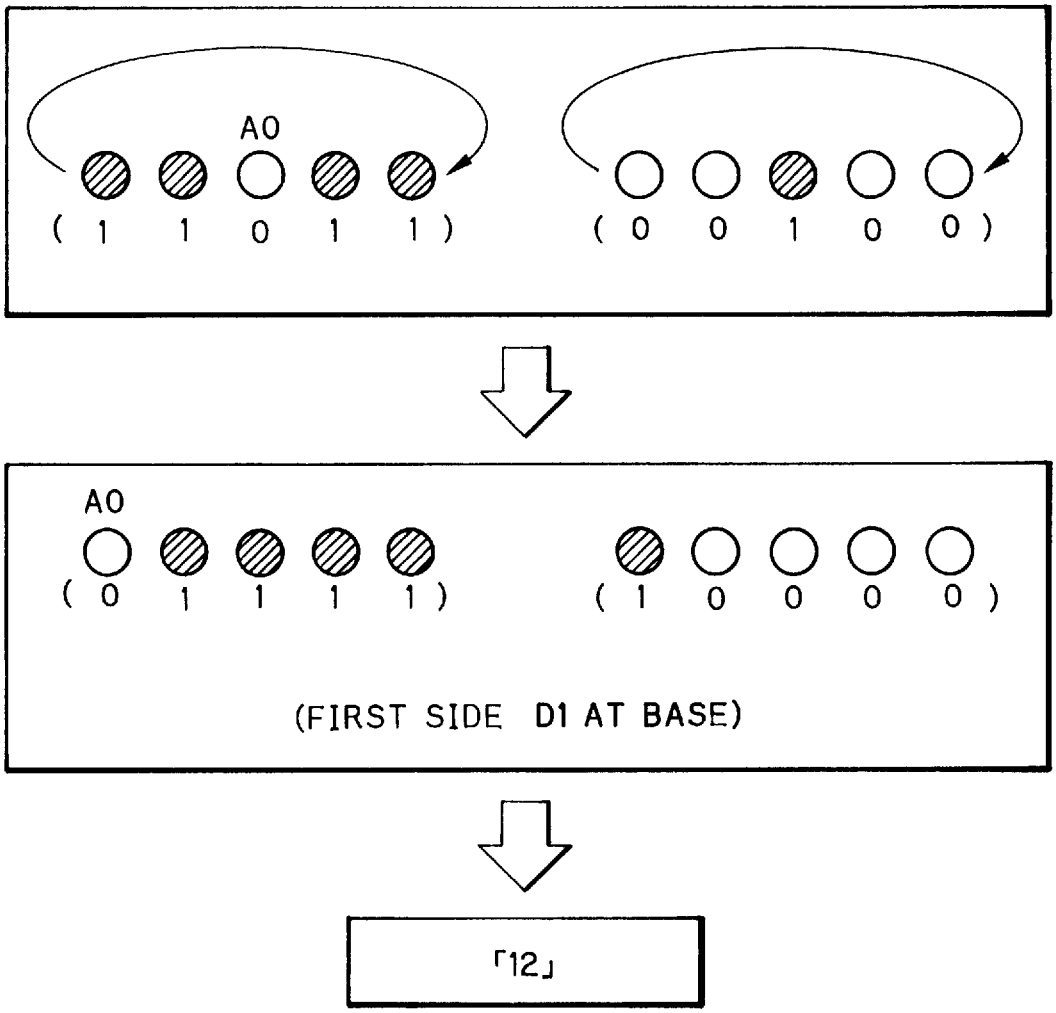
FIG. 9 is an illustrative diagram showing a sequence of conversion into a symbol identifier signal.

FIG. 9 illustrates a sequence of shifting the signals of five bits and identifying the effective symbol. In FIG. 9, the signals are represented by the magnet pins so as to have a correspondence with the layout pattern of the magnet pins shown in FIG. 5. A circle represents a hole without a magnet pin, and a hatched circle represents a hole with a magnet pin. In the upper frame, the leftmost circle corresponds to a hole facing the posture detecting Hall element H0, and the rightmost circle corresponds to a hole facing the symbol detecting Hall element H9.

No posture identifier magnet pin has been inserted in the reference hole A0. The signals of five bits are shifted so that the reference hole A0 comes to the leftmost side or the first position as viewed in FIG. 9. In this example, since the reference hole H0 is at the third position, all the bits are shifted by two bits so that the reference hole A0 faces the posture detecting Hall element H0. The signals of five bits detected by the symbol detecting Hall elements H4 to H9 are also shifted by two bits to convert the symbol identifier signal into a correct symbol identifier signal "10000". This symbol identifier signal indicates a number "12" as the effective signal as shown in FIG. 6.

If the player has selected the number "12", then the game is a win and a predetermined score is given. This number "12" and score are displayed on the display 32. If a wrong number has been selected, no score is given. In the above manner, one number guessing game is completed.

FIG. 10 shows another layout of symbol identifier magnet pins. In this example, only two sides have three magnet pins, and the other sides have two magnet pins. Therefore, as compared to the example shown in FIG. 6, a difference between the numbers of magnet pins of the sides is smaller so that the balance of the die 26 can be improved.

FIG. 11 illustrates various types of games using the dice player. The first game is a number guessing game described above. The second game is a scoring game to be played by a plurality of players. A seal drawn with a score is attached to each side of a die. The first side has a score "10", and the twelfth side has a score "300". A score on the effective side is displayed on the display. A win or loss of a plurality of players is determined from whether the score is larger or smaller. The number of games may be one or more. If a predetermined number of games is performed, the score of each game is accumulated and a win or loss is determined from whether the accumulated score is larger or smaller.

The third game is a slot game. A hit symbol combination or a miss symbol combination is drawn on each side of a die. If the symbol combination on the effective side is a hit symbol combination, a score predetermined for this hit symbol combination is given to the player. The symbol combination on the effective side and score are displayed on the display. For the miss symbol combination, no score is given. In this way, the first side has a hit symbol combination with a high score, and the eleventh side has a hit symbol combination with a low score. The other sides have a miss symbol combination.

The fourth game is a horse race game. Each side of a die has a picture of a horse and a number. In this horse race game, similar to the number guessing game, the number of the first horse is predicted. If the number of the first horse hits, a predetermined score is given. The die may be rotated twice in succession to predict the first horse for the first rotation and the second horse for the second rotation.

The fifth game is a motor boat race game. In this motor boat race game, a die is used which has on each side a boat picture and a number. The game contents are similar to the horse race game.

The first to fifth games may be selectively played by using a die with the numbers "1" to "12". In this case, a key for selecting the game is provided on the operation panel. In order for a player easily to confirm a selected game, a table indicating a relationship between the numbers and symbols of the dice may be attached to the game machine, or the symbols of the selected game may be displayed on the display 32.

In this case, the identifier signal generator of each side generates an identifier signal for identifying the effective side. The memory 31*a* stores first table data representative of a relationship between the identifier signal of each side and the effective side, and second table data representative of a relationship between the effective side and symbol. The microcomputer 31 refers to the first table data, to identify an effective side from the identifier signal. Next, referring to the second table data, the symbol of the selected game is identified and displayed on the display 32. The microcomputer 31 calculates a score predetermined in accordance with the selected game, and displays it on the display 32.

Figure 12:
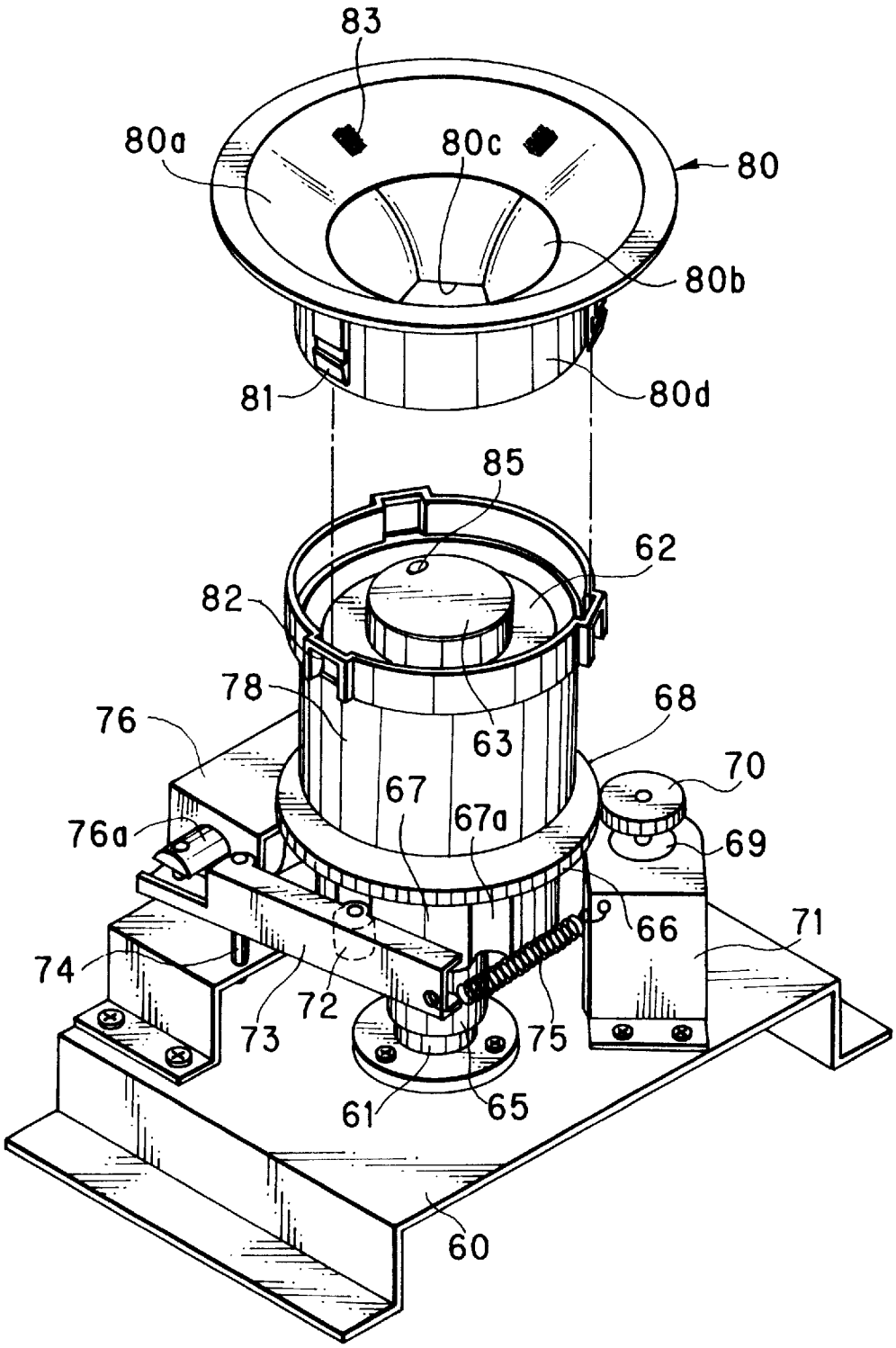
FIG. 12 is a perspective view of a dice game machine according to another embodiment.

In the dice game machine shown in FIG. 1, the motor with a braking mechanism is used for stopping the cup at a specific position. FIG. 12 shows a dice game machine with a separate stopping mechanism. A pipe 61 in which signal wires are inserted is fixed on a base plate 60 by screws. Above this pipe 61, a cylindrical housing 62 is fixedly mounted. In the upper portion of this housing 62, a sensor board (not shown) with a plurality of Hall elements is accommodated. A stage 63 is fixed at the upper opening end of the housing 62.

A shaft 65 is rotatively mounted on the pipe 61 by a bearing (not shown). A cup support 68 constituted by a gear 66 and a stop cam 67 is fixed to the upper end of the shaft 65. This gear 66 meshes with a gear 70 of a motor 69. The motor 69 may be a usual d.c. motor, a pulse motor, or the like without a braking mechanism. The motor 69 is mounted on a bracket 71 fixed to the base plate 60.

The stop cam 67 is formed with a generally triangular groove 67*a*. If a regular dodecahedral die is used, the cup stops positions are five at a maximum. In this example, five grooves 67*a* are formed at a pitch of 72 degrees. When a stop roller 72 enters one of the grooves 67*a*, the cup support 68 can be stopped forcibly at a predetermined position.

The stop roller 72 is rotatively mounted on an arm 73 which is supported by a shaft 74. A spring 75 is coupled to one end of the arm 73 to bias the arm 73 in the direction that the stop roller 72 enters the groove 67*a*. The other end of the arm 73 is coupled to an armature 76*a* of a solenoid 76. When power is supplied to the solenoid 76, the stop roller 72 moves out of the groove 67*a*. The stop mechanism is constituted by the stop cam 67, stop roller 72, arm 73, spring 75, and solenoid 76.

A cylindrical lower cup 78 is fixedly mounted on the cup support 68, and an upper cup 80 is unitarily mounted on the lower cup 78, to thereby constitute a cup. The upper cup 80 includes a truncated cone portion 80*a*, a pyramidal portion 80*b* of truncated hexahedron shape, and a tubular portion 80*d*.

The tubular portion 80*d* surrounds the pyramidal portion 80*b*, and three engaging claws 81 are formed at the lower portion of the tubular portion 80*d*. When the tubular portion 80*d* is fitted in the upper inside of the lower cup 78, the engaging claws 81 engage with bridges 82 of the lower cup 78. In the state when the upper cup 80 is mounted on the lower cup 78, one of the corners of a pentagonal base opening 80*c* coincides in position with a positioning pin 85.

During the rotation of the cup, a die autorotates and revolves in the cone portion 80*a*. In order to facilitate this autorotation, a plurality of brush chips 83 are attached to the cone portion 80*a*. As static electricity builds up in the die under rotation, the die attracts dust and becomes dirty. Therefore, it is preferable to make the brush chips 83 of elastic anti-static material. Instead of a brush chip, a rubber chip or a protrusion may be used. A brush chip, rubber chip or protrusion may be attached to the inner wall of the cover over the cup.

In order to avoid erroneous detection by each Hall element, the housing 62, cup support 68, lower cup 78, and upper cup 80 are made of plastic. The base plate 60, pipe 61, shaft 65, arm 73, and the like are made of iron. The dice is made of rubber or plastic.

Shortly before the rotation of the cup, power is supplied to the solenoid 76. The solenoid 76 rotates the arm 73 in the clockwise direction against the force of the spring 75 to move the stop pin 72 out of the groove 67*a*. Next, power is supplied to the motor 69 to rotate it. Therefore, the cup support 68 rotates via the gears 70 and 66. Together with the cup support 68, the lower and upper cups 78 and 80 rotate. The die in the upper cup 80 moves upward from the pyramidal portion 80*b* and autorotates and revolves in the cone portion 80*a*. After a proper time lapse, the power supply to the motor 69 and solenoid 76 is stopped.

After the power supply to the motor 69 is stopped, the cup support 68 and cup continue to rotate by inertia, while being decelerated. During this rotation by inertia, as the stop roller 72 faces the groove 67*a*, it enters this groove 67*a* by the force of the spring 75 to forcibly stop the cup support 68. Therefore, one of the corners of the pentagonal base opening 80*c* becomes coincident in position with the positioning pin 85, so that each Hall element of the sensor board takes a position just under each magnet pin of the die.

When the rotation of the cup stops, the die falls into the pyramidal portion 80*d* and one pentagonal side of the die enters the base opening 80*c*. A symbol identifier signal from the symbol identifier signal generator under the side of the die is read by each Hall element of the sensor board.

Figure 13:
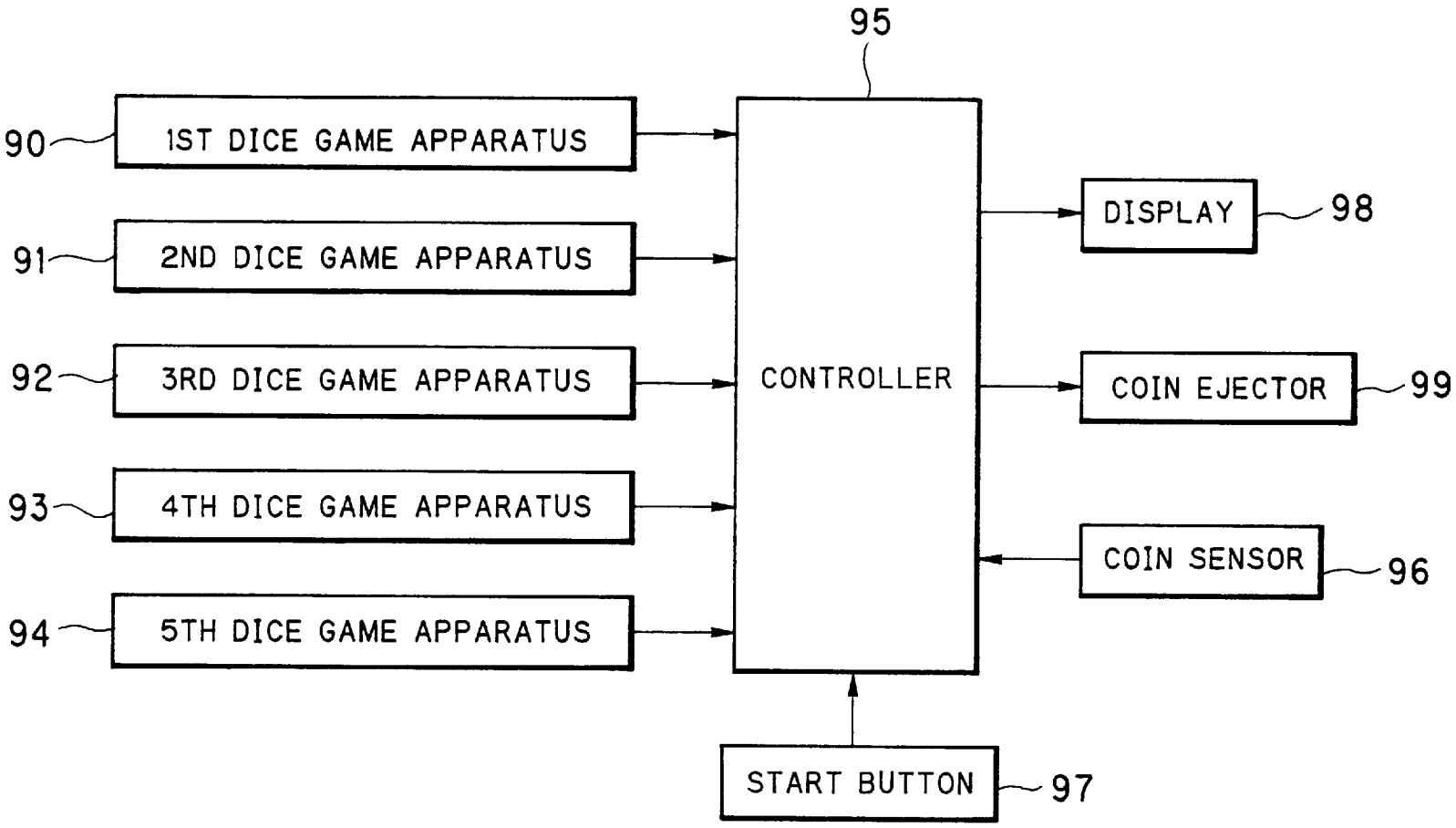
FIG. 13 is a block diagram of a dice game system using five dice game machines.

FIG. 13 shows a dice game system for playing a slot game using five dice game machines. First to fifth dice game machines 90 to 94 are connected to a controller 95, and each dice apparatus 90 to 94 accommodates a regular dodecahedral die described earlier. Each side of each die bears a slot game symbol, such as "7", "cherry", "bell", and "watermelon".

Prior to the start of a slot game, a predetermined number of coins are inserted into a coin inlet. The inserted coins are detected by a coin sensor 96. If a predetermined number of coins are inserted, the controller 95 permits the start of a game. Thereafter, upon actuation of a start button 97, the controller 95 operates all the dice game machines 90 to 94 at the same time.

Each dice game machine 90 to 94 rotates the cup. After a proper time lapse, the controller 95 instructs each dice game machine 90 to 94 to stop. When each cup stops, the die in the cup stops in a predetermined posture.

The controller 95 sequentially receives the symbol identifier signal starting from the first dice game machine 90. The five effective symbols starting from the first dice game machine 90 are displayed in a row on a display 98. If the combination of the five effective symbols coincides with a win symbol combination, a predetermined number of coins corresponding to the rank of the win symbol combination are ejected by a coin ejector 99.

Since five regular dodecahedral dice are used, the number of symbol combinations is $12^5$=248382 which is about 32-fold the number of combinations of regular hexagonal dice, which is 7776.

Figure 14:
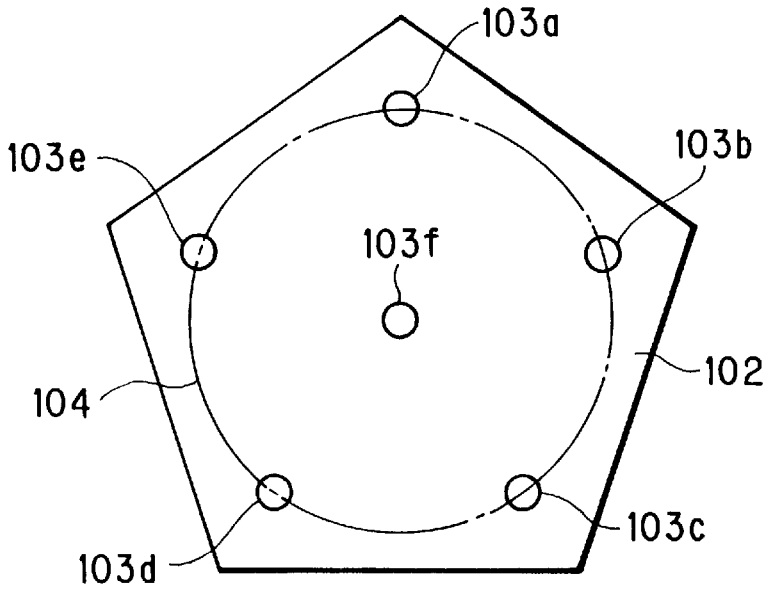
FIG. 14 is a plan view of one side of a die, showing another example of a layout of magnet pins.

FIG. 14 shows another layout of magnet pins. Six holes 103*a* to 103*f* are formed in each side 102 of a regular dodecahedral die. The five holes 103*a* to 103*e* are disposed at a pitch of 72 degrees on a circle 104. The hole 103*a* is a reference hole. The holes 103*b* to 103*e* are used for symbol identification into which magnet pins are selectively inserted in accordance with the binary value of a number on the effective side. The central hole 103*f* is used for posture detection and a posture identifier magnet pin is inserted therein. In this example, the number of magnet pins can be reduced.

If no magnet pin is inserted in any of the holes 103*b* to 103*e*, this indicates a number "1". If a magnet pin is inserted only in the hole 103*b*, it indicates a number "2". If a magnet pin is inserted only in the hole 103*c*, it indicates a number "3". If magnet pins are inserted in both the holes 103*b* and 103*c*, it indicates a number "4". If a magnet pin is inserted only in the hole 103*d*, it indicates a number "5". In a similar manner, magnet pins are inserted in various combinations in various holes. In this way, numbers "1" to "16" can be expressed by using four holes.

Figure 15:
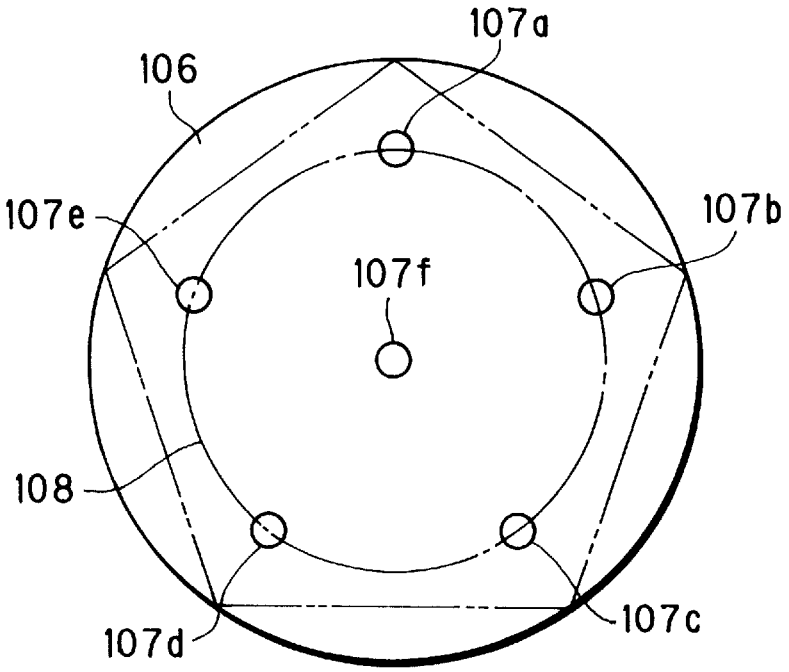
FIG. 15 is a plan view of a sensor board used in combination with the die shown in FIG. 14.

FIG. 15 shows a sensor board used in combination with the die shown in FIG. 14. This sensor board 106 has five Hall elements 107*a* to 107*e* disposed at a pitch of 72 degrees on a circle 108. This circle 108 has the same radius as the circle 104 shown in FIG. 14. At the center of the sensor board 106, a Hall element 107*f* is disposed in correspondence with the hole 103*f*.

Figure 16:
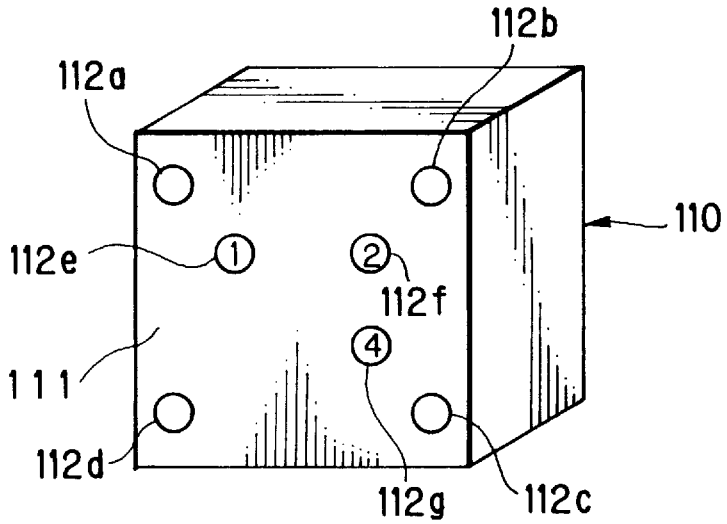
FIG. 16 is a perspective view of a die of regular hexahedron shape.

FIG. 16 shows a regular hexahedral die. The hexahedral die 110 has six square sides 111. For this die 110, a cup having a pyramidal portion with four tapered sides and a square base opening is used.

Each side is formed with holes 112*a* to 112*d* at four corners. The hole 112*a* is a reference hole in which there is no magnet pin. Posture identifier magnet pins are inserted into the holes 112*b* to 112*d*.

Three holes 112*e* to 112*g* at the inner area of the side 111 are used for symbol identification and magnet pins are selectively inserted therein in accordance with the number of the effective side. The numbers affixed to the holes 112*e* to 112*g* are numbers represented by the magnet pins. For example, if a magnet pin is inserted only in the hole 112*e*, it indicates a number "1". If a magnet pin is inserted only in the hole 112*f*, it indicates a number "2". If a magnet pin is inserted only in the hole 112*g*, it indicates a number "4". If magnet pins are inserted in both the holes 112*e* and 112*f*, it indicates a number '3". If magnet pins are inserted in both the holes 112*f* and 112*g*, it indicates a number "6".

Figure 17:
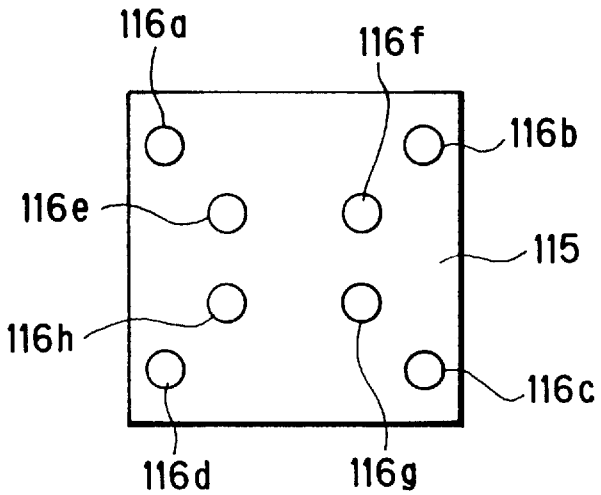
FIG. 17 is a plan view of a sensor board used in combination with the die shown in FIG. 16.

FIG. 17 shows a sensor board used in combination with the die shown in FIG. 16. This sensor board 115 has four Hall elements 116*a* to 116*d* in correspondence with the holes 112*a* to 112*d* of the die 110. Four Hall elements 116*e* to 116*h* are disposed in correspondence with the three holes 112*e* to 112*g*.

Figure 18:
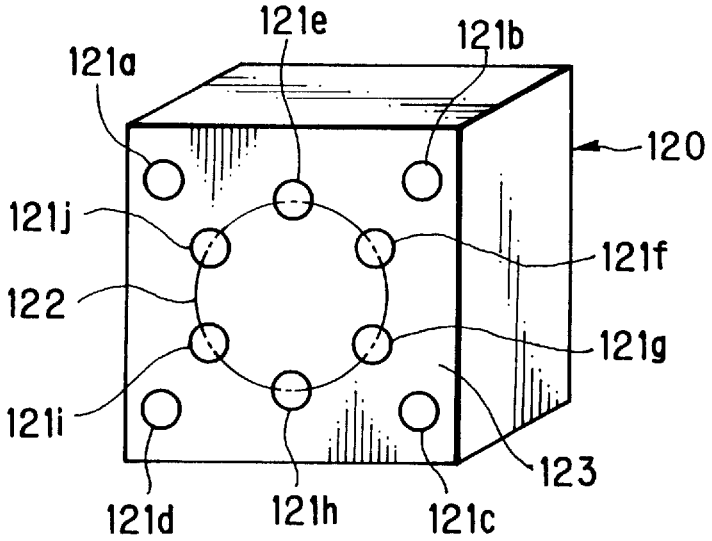
FIG. 18 is a perspective view showing another example of a die of regular hexahedron shape.

FIG. 18 shows another layout of magnet pins. Each side 123 of a regular hexahedral die 120 is formed with four holes 112*a* to 112*d*. Posture identifier magnet pins are inserted in all the holes 121*a* to 121*d*.

Six holes 121*e* to 121*j* are disposed at a predetermined angle pitch on a circle 122. Magnet pins corresponding in number to the symbol number on the effective side are inserted in the six holes 121*e* to 121*j*. For example, for a number "1", one magnet pin is inserted into an arbitrary hole. For a number "4", four magnet pins are inserted into arbitrary four holes. In this example, since the number on the effective side can be known from the number of magnet pins, a reference hole is not needed.

Figure 19:
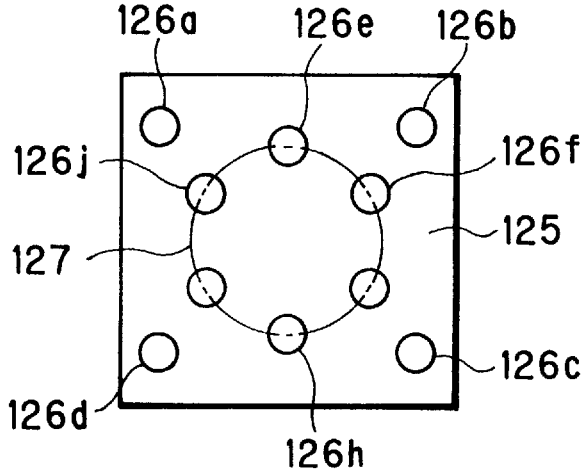
FIG. 19 is a plan view of a sensor board used in combination with the die shown in FIG. 18.

FIG. 19 shows a sensor board used in combination with the die shown in FIG. 18. This sensor board 115 has ten Hall elements 126*a* to 126*j* in correspondence with the holes 121*a* to 121*j* of the die 120.

Figure 20:
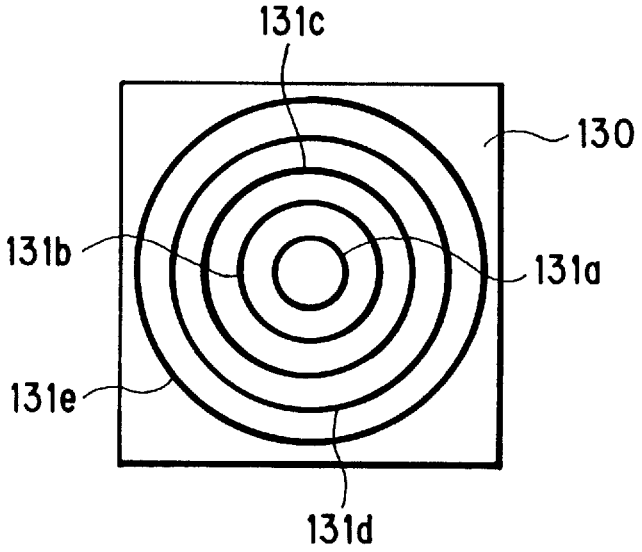
FIG. 20 is a perspective view of a die of regular hexahedron shape using magnet pins of a ring shape.

In the die shown in FIG. 20, each side 130 is formed with five holes 131*a* to 131*e* of a ring shape. A posture identifier magnet ring is inserted in the hole 131*a*. Symbol identifier magnet rings, four at a maximum, are inserted in the holes 131*b* to 131*e* in accordance with the code of the number.

Figure 21:
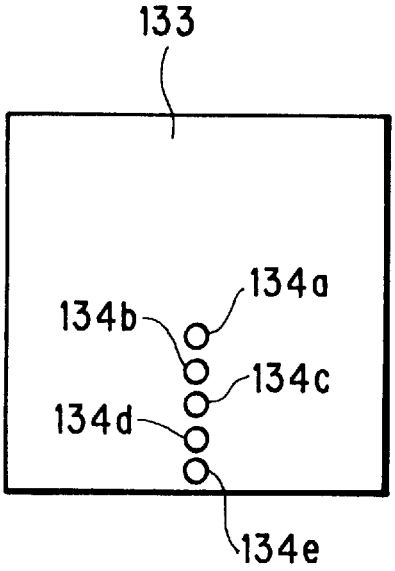
FIG. 21 is a plan view of a sensor substrate used in combination with the die shown in FIG. 20.

FIG. 21 shows a sensor board used in combination with the die shown in FIG. 20. This sensor board 133 has five Hall elements 134*a* to 134*f* in correspondence with the holes 131*a* to 131*e*. In this example, since a ring shaped magnet is used, the symbol identifier signal can be read irrespective of the rotation angle of the die. Therefore, the cup can be stopped at any arbitrary position.

In the embodiment shown in FIG. 14, a ferromagnetic member such as iron may be inserted into the central hole and an electromagnet is disposed on the sensor board. In this case, the electromagnet is temporarily powered when the cup stops, thereby to attract the ferromagnetic member and to set the die in the pyramidal portion in a correct posture. If there is no adverse influence upon the Hall element, the electromagnet may be powered until the symbol identifier signal is read completely.

A die pusher mechanism having an extensible arm may be mounted inside the cover. While the cup rotates, the arm is pulled upward, and when the cup stops, the arm is extended downward. A small transparent plate is mounted to the lower end of the arm to push the die. Since the base side of the die is pushed against the stage, signal reading with Hall elements becomes reliable. A plurality of suction holes may be formed in the stage for vacuum suction of the die and good contact with the stage. In these cases, a magnet pin and Hall element for posture detection may be omitted.

In the above embodiments, for detecting the symbol and side of a die, a magnetic sensor is used. Other sensors may also be used. For example, an optical mark may be provided on each side of a die, and this mark may be read by a photosensor through a transparent stage. A symbol or code on each side may be recorded in a form of a bar code to be read with a bar code sensor. A contact pattern on conductive and non-conductive areas may be formed on each side to be read by using contacts formed on the stage.

The dice game machine of this invention is applicable to a poker game, a baccarat game, a soccer (Football) game, a backgammon game, a craps game, a large-and-small game, a bingo game, a keno game, and the like. The dice game machine of this invention may be used with a pinball machine wherein when a ball enters a particular safe hole, the dice game is activated, and when a particular symbol appears, an attacker may be activated.

The dice game machine of this invention may be assembled as a subsidiary game machine with another game machine wherein when a particular win is obtained by the main game machine, the dice game machine is activated to play a subsidiary game.

Various modifications and changes of the invention are possible which should be construed as falling within the protective scope of this invention.

What is claimed is:

1. A dice game machine comprising:

a regular polyhedral die having at least six sides, each of said sides having a symbol specific to the side and having the same size and shape, wherein when the die is at rest, one of said sides at a predetermined position is an effective side for determining an outcome of a game played with the machine;

an identifier signal generator provided for each side of said die, said identifier signal generator generating an identifier signal for identifying the symbol on the effective side;

a rotatable cup that spins around a vertical axis for accommodating said die, the cup having an upper portion, a lower portion, and a base opening, said upper portion having a space in which said die can freely move during rotation of the cup, said lower portion having a configuration such that when said cup stops, said die fits into said lower portion in a predetermined posture, and said base opening having the same shape as each side of said die;

driving means for rotating said cup;

a stage across said base opening, said die fitted into said lower portion of said cup being in contact with said stage at one bottom side of said die;

a signal detector mounted on said stage for detecting said identifier signal on the bottom side in contact with said stage via said base opening when said die is fitted in said lower portion of said cup, thereby to identify a symbol on the effective side of said die.

2. A dice game machine according to claim 1, wherein:

said die, said cup, and said stage are made of non-magnetic material;

said signal detector includes a plurality of symbol detecting Hall elements; and each said identifier signal generator includes a plurality of symbol identifier magnets selectively disposed at positions on said die corresponding to said symbol detecting Hall elements.

3. A dice game machine according to claim 2, further comprising a computer and a display wherein:

said computer judges a symbol on said effective side from the identifier signal detected by said symbol detecting Hall elements, and in accordance with the judged symbol, determines a prize; and said display displays said prize calculated by said computer.

4. A dice game machine according to claim 3, wherein said display further displays the symbol on said effective side.

5. A dice game machine according to claim 4, wherein said prize is a score.

6. A dice game machine according to claim 2, wherein:

said stage is stationary; and said driving means spins said cup around the vertical axis and thereafter stops said cup in at least one predetermined stop position.

7. A dice game machine according to claim 6, wherein said upper portion of said cup is of a truncated cone shape with a smaller radius at a lower position so that when the rotation of said cup stops, said die slides and falls down into said lower portion.

8. A dice game machine comprising:

a die having at least six sides, each of said sides having a symbol specific to the side and having the same size and shape, a one of said sides that has a predetermined position when said die is at rest being an effective side for determining an outcome of a game played with the machine;

a rotatable cup for accommodating said die, said cup having an upper portion in which said die is able to move freely, a lower portion for holding said die in a predetermined posture, and a base opening having a shape the same as said sides, wherein said upper portion is arranged so that when said cup is not rotating said die falls to said lower portion, and wherein said lower portion of said cup is generally of a truncated pyramidal shape having said base opening at the plane of truncation;

driving means for rotating said cup and for stopping said cup in at least one predetermined stop position;

a stationary stage across said base opening, one of said sides of said die contacting said stage when said die is in said lower portion;

a plurality of symbol identifier magnets on each side of said die for providing magnetic fields that identify the symbol on said effective side; and a plurality of Hall detection elements on said stage for detecting said magnetic fields on the one of said sides contacting said stage to thereby identify the symbol on said effective side.

9. A dice game machine according to claim 8, wherein said driving means comprises:

a motor for rotating said cup; and a stop mechanism for forcibly stopping said cup in at least said one stop position at the same time when or immediately after a power supply to said motor is turned off.

10. A dice game machine according to claim 9, wherein at least said one stop position comprises N stop positions where N is the number of edges of each side of said die, each stop position being set at a rotary angle of 360/N degrees from a reference position of said stage.

11. A dice game machine according to claim 10, further comprising dice posture detecting means for detecting a correct posture wherein the whole surface of the bottom side of said die is in contact with said stage when the rotation of said cup stops, said dice posture detecting means including at least one posture detecting Hall element mounted on said stage and at least one posture identifier magnet disposed on each side of said die in correspondence with at least said one posture detecting Hall element.

12. A dice game machine according to claim 11, wherein:

the number of the plurality of symbol detecting Hall elements is N where N is the number of edges of each side of said die, said symbol detecting Hall elements being disposed at N positions at a pitch of 360/N degrees on a circle having a radius of R concentric with the center of said stage; and said symbol identifier magnets are selectively disposed at N positions in correspondence with said symbol detecting Hall elements to change a layout pattern of symbol identifier magnets for each side.

13. A dice game machine according to claim 12, wherein:

said at least one posture detecting Hall element comprises N posture detecting Hall elements disposed at a pitch of 360/N degrees on a circle having a radius of R1 wherein R1 is not equal to R, said circle being concentric with the center of said stage, N being an integer of at least three; and said at least one posture identifier magnet comprises N−1 posture identifier magnets, one of N positions of said posture identifier magnets being an empty position without said posture identifier magnet, said one position being used for determining a sequential order of N signals from said N symbol detecting Hall elements.

14. A dice game machine according to claim 13, wherein said N symbol detecting Hall elements and said N posture detecting Hall elements are displaced by an angle of 180/N degrees.

15. A dice game machine according to claim 14, wherein said N−1 posture identifier magnets are disposed near the corners of each side of said die.

16. A dice game machine according to claim 11, wherein the number of the plurality of symbol detecting Hall elements is the same as the number M of sides of said die, said M symbol detecting Hall elements being disposed at a pitch of 360/M degrees on the circle having the radius R concentric with the center of said stage, the plurality of symbol identifier magnets being selectively disposed at M positions, and the number of disposed symbol identifier magnets representing a symbol on said effective side.

17. A dice game machine according to claim 11, wherein the plurality of symbol identifier magnets are of a ring shape each having a different radius, and the plurality of symbol detecting Hall elements are disposed in line.

18. A dice game machine according to claim 11, wherein a plurality of projecting members are disposed at predetermined positions of said upper portion of said cup for facilitating the rotation of said die.

19. A dice game machine according to claim 11, wherein said stop mechanism comprises:

a rotary member rotating with said cup;

a plurality of recesses formed in the circumferential area of said rotary member at a pitch of 360/N degrees;

a stop roller capable of being fitted in each of the plurality of recesses;

a stop lever for holding said stop roller, said stop lever taking a first position wherein said stop roller enters one of the plurality of recesses and a second position wherein said stop roller moves out of said one recess;

a biasing member for biasing said stop lever toward said first position; and a solenoid for determining the position of said stop lever, said solenoid holding said stop lever at said second position against a force of said biasing member during the rotation of said motor, and allowing said biasing member to move said stop lever to said first position when the rotation of said cup stops.

20. A dice game system having a plurality of dice machines, a computer, and a display, wherein:

each said dice machine comprises:

(A) a regular polyhedral die having at least six sides, each of said sides having a symbol specific to the side and having the same shape and size, wherein when the die is at rest, one of said sides facing a predetermined direction is an effective side for indicating an outcome of a game played with said system;

(B) an identifier signal generator provided for each side of said die, said identifier signal generator generating an identifier signal for identifying the symbol of the effective side;

(C) a rotatable cup that spins around a vertical axis for accommodating said die, the cup having an upper portion, a lower portion, and a base opening, said upper portion having a space in which said die can freely move during the rotation of said cup, said lower portion having a configuration such that when said cup stops, said die is fitted into said lower portion in a predetermined posture, and said base opening having the same shape as each side of said die;

(D) driving means for rotating said cup;

(E) a stage disposed across said base opening, said die fitted in said lower portion of said cup being in contact with said stage at one bottom side of the die; and (F) a signal detector mounted on said stage for detecting said identifier signal from the bottom side of the die in contact with said stage via said base opening when said die is fitted in said lower portion of said cup; and wherein said computer receives said identifier signal from each said signal detector and displays symbols for said dice game machines on said display.

21. A dice game system according to claim 20, wherein said computer determines a prize in accordance with a combination of said symbols and displays said prize on said display.

22. A die of regular polyhedron shape having M sides, each of said sides having a symbol and having the same shape and size, wherein:

when the die is at rest, one of said sides in a predetermined position is an effective side for indicating an outcome of a game played with the die;

said die is made of non-magnetic material; and said die has a plurality of symbol identifier magnet pins disposed on each side, said symbol identifier magnet pins having a layout pattern representative of a symbol on the effective side.

23. A die according to claim 22, wherein said number M is 6 or 12.

24. A die according to claim 23, wherein each side of said die has a plurality of posture identifier magnet pins near the corners of said die.

25. A die comprising:

a non-magnetic material of regular polyhedron shape having 6 or 12 sides, each of said sides having a symbol and having the same shape and size, wherein when the die is at rest, one of said sides in a predetermined position is an effective side for indicating an outcome of a game played with the die;

posture identifier magnet pins in each of said sides; and a plurality of symbol identifier magnet pins in each of said sides, said pins on each of said sides being in a pattern representative of the symbol on the effective side;

wherein said symbol identifier magnet pins are selectively mounted at N positions at a pitch of 360/N degrees on a circle having a radius R concentric with the center of each side, where N is the number of edges of each side of said die.

26. A die according to claim 25, wherein said symbol identifier magnet pins are disposed in an array disposed inside an array of said posture identifier magnet pins, the symbol identifier magnet pins being displaced from the posture identifier magnet pins by an angle of 180/N degrees.

27. A die according to claim 26, further including a weight movably housed in a hollow inner space of said die.

* * * * *